United States Patent [19]

Banasiuk

[11] 4,399,863

[45] Aug. 23, 1983

[54] FLOATING SEAL SYSTEM FOR ROTARY DEVICES

[75] Inventor: Hubert A. Banasiuk, Chicago, Ill.

[73] Assignee: Institute of Gas Technology, Chicago, Ill.

[21] Appl. No.: 332,380

[22] Filed: Dec. 21, 1981

[51] Int. Cl.[3] ..... F28D 19/00

[52] U.S. Cl. ..... 165/9; 62/271; 277/81 R; 277/83; 277/92

[58] Field of Search ..... 165/9; 62/271; 277/81 R, 83, 92

[56] References Cited

U.S. PATENT DOCUMENTS

| | | | |
|---|---|---|---|
| 3,856,077 | 12/1974 | Siegla | 165/9 |
| 3,907,310 | 9/1975 | Du four | 165/9 X |
| 3,931,852 | 1/1976 | Rao | 165/9 |
| 4,024,905 | 5/1977 | Guillot | 165/9 |
| 4,024,906 | 5/1977 | Bramley | 165/9 |

*Primary Examiner*—Albert W. Davis, Jr.
*Attorney, Agent, or Firm*—Thomas W. Speckman

[57] ABSTRACT

This invention relates to a floating seal system for rotary devices to reduce gas leakage around the rotary device in a duct and across the face of the rotary device to an adjacent duct. The peripheral seal bodies are made of resilient material having a generally U-shaped cross section wherein one of the legs is secured to a support member and the other of the legs forms a contacting seal against the rotary device. The legs of the peripheral seal form an extended angle of intersection of about 10° to about 30° in the unloaded condition to provide even sealing forces around the periphery of the rotary device. The peripheral seal extends around the periphery of the support member except where intersected by radial seals which reduce gas leakage across the face of the rotary device and between adjacent duct portions. The radial seal assembly is fabricated from channel bars, the smaller channel bar being secured to the divider of the support member and a larger inverted rigid floating channel bar having its legs freely movable over the legs of the smaller channel bar forming therewith a tubular channel. A resilient flexible tube is positioned within the tubular channel for substantially its full length to reduce gas leakage across the tubular channel. A spacer extends beyond the face of the floating channel near each end of the floating channel a distance to provide desired clearance between the floating channel and the face of the rotary device.

32 Claims, 5 Drawing Figures

FLOATING SEAL SYSTEM FOR ROTARY DEVICES

The U.S. Government has rights in this invention pursuant to Contract No. DE-AC03-77-CS34495 awarded by the U.S. Department of Energy.

BACKGROUND OF THE INVENTION

This invention relates to a floating seal system for rotary devices to reduce gas leakage around the rotary device in a duct and across the face of the device to an adjacent duct. Principal uses of such rotary devices including regenerative exchangers for vapor or chemical removal or heat exchange. Typically, the rotary regenerative exchangers embody the use of exchange material wheels mounted for rotation on an axle or by peripheral gears. Supported between the center hub and outer rim is the exchange material having gas passage essentially parallel to central axis. The rotary regenerative exchangers usually pass through adjacent ducted treatment and regenerative gas streams.

Early use of the rotary regenerative exchangers required precise fabrication of both housing and exchanger wheel assembly due to poor sealing mechanisms. Short circuiting of gas across the face or around the perimeter of the exchanger wheel results in a significant decrease in exchanger efficiency. The precise fabrication required to maintain an acceptable efficiency in the absence of adequate seal systems imposes severe limitations on the use of such rotary regenerative exchangers. Less precise fabrication methods not only require better seal systems to prevent short circuiting, but require the seal system compensate for axial misalignment and uneveness of the regenerator wheel contact surfaces.

U.S. Pat. No. 3,931,852 teaches a seal system for rotary regenerator exchangers with a circular cermic regenerator core. The seal system comprises a plurality of monolithic ceramic seal elements assembled in generally end to end relationship to form peripheral and radial seals. Monolithic seal elements are located within cavities with heat resistant resilient material beneath the seals being cooled by air flow. Likewise, U.S. Pat. No. 4,024,905 teaches a seal system for rotary ceramic heat exchangers fitted to gas turbines wherein U-shaped sealing shoes are held against the rotating ceramic heat exchanger surface by a plurality of springs. The plurality of seal springs compensate for the non-planar condition of the heat exchanger wheel. The two aforementioned seal systems directly contact the surface of the porous ceramic heat exchange wheel used in gas turbines. This type of direct contacting seal is not acceptable for rotary exchangers having soft, easily scored surfaces, such as moisture exchanger wheels for adsorption air conditioning equipment. The present invention differs from the direct contacting seal in that it is suitable for soft surface paper or asbestos moisture exchanger wheels since the seal assembly does not come into direct contact with exchange wheel material.

U.S. Pat. No. 4,024,906 teaches a seal system for maintaining separation of fluids in a gas turbine comprising an arcuate portion co-axial with the matrix and a transverse portion extending diametrically, each seal secured to a pressure plate engaging the end face of the matrix. As with the aforementioned seal systems, the seal system of U.S. Pat. No. 4,024,906 relies on direct contact between seal and exchange material and, therefore, cannot be used with relatively delicate absorbent or adsorbent exchanger materials.

The floating seal system taught by U.S. Pat. No. 3,907,310 overcomes many of the disadvantages referred to above. However, the seal system taught by the U.S. Pat. No. 3,907,310 does not provide desired extent of prevention of gas leakage due primarily to stiffness of the components resulting from their structural design and due to excessive leakage at the juncture of the radial and peripheral seals.

SUMMARY OF THE INVENTION

This invention provides a floating seal system for rotary exchange mechanisms which are operated between support members within a divided duct to reduce gas leakage around the periphery of the rotary device and across the face of the rotary device.

This invention provides an outer peripheral seal secured to an outer peripheral flange of the support member juxtapositioned to an outer peripheral flange of the rotary device. The peripheral seal body is made of resilient material having a generally U-shaped cross section of two legs joined at one end by a central section. One of the legs is secured to the support member outer peripheral flange and the other leg has on its outer surface low friction material for contact with the rotary device outer peripheral flange. The legs form an extended angle of intersection of about 10° to 30° to each other in the unloaded condition providing even sealing forces against the rotary device outer peripheral flange in the loaded condition. The peripheral seal extends completely around the periphery of the support member except where it is intersected by radial seals.

The radial seal assembly is secured to the support member along the divider of the duct. The radial seal assembly has a smaller channel bar secured to the divider of the support member, a larger inverted, rigid, floating channel bar having its legs freely movable over the legs of the smaller channel bar forming a tubular channel therewith. A resilient flexible tube is positioned within the tubular channel for substantially its full length to reduce gas leakage across the tubular channel. A spacer near each end of the floating channel extends beyond the face of the floating channel a distance of the desired clearance between the floating channel and the face of the rotary device. The spacer at each end of the floating channel is maintained in contact relation with contact surfaces of the rotary device by spring means near each end of the floating channel coacting betwen the smaller channel and the floating channel, thereby maintaining a controlled clearance between the face of the rotary device and the face of the floating channel bar.

An important aspect of this invention is the junction of the peripheral and radial seals wherein the peripheral seal ends abut the legs of the floating channel of each radial seal assembly.

Clearance between the radial seal and rotary exchanger face is readily adjustable by exchanging the shims in the spacer assemblies near the end of each radial seal member. The controlled clearance provides for reduction of short circuiting of gases across the face of the exchanger wheel, particularly leakage enhanced by pressure differentials in different portions of the divided duct, while affording sufficient clearance to avoid damage of soft rotary exchanger materials. The flexibility of the peripheral seal and constant force along its entire length affords imporved peripheral sealing while compensating for axial misalignment and uneveness of the rotary exchanger contact surfaces. Generally, similar peripheral seal members are used to seal both inner hub and peripheral rims on each side of a rotary exchanger supported by a central shaft.

The floating seal system of this invention is well suited to the rotary regenerable desiccant wheel and rotary thermal exchange wheel of a solid adsorption environmental control system. For example, the seal system of this invention is well suited for use in combination with the heat exchange wheel and drying wheel of the open-cycle air conditioning apparatus as described in U.S. Pat. Nos. 3,880,224, 3,889,742, and 4,180,126, all incorporated herein by reference in their entirety. We have found that using prior seals of the type disclosed in U.S. Pat. No. 3,907,310 in open-cycle air conditioning apparatus that up to about 20 percent mass flow rate loss results, while using seals of this invention the loss can be reduced to about 5 to 10 percent.

It is an object of this invention to increase the efficiency of rotary exchange mechanisms by reducing gas leakage across the face and arond the periphery of the rotary exchanger.

It is another object of this invention to reduce short circuiting across the face of a rotary exchanger by providing radial seal members of controlled clearance capable of maintaining close tolerances.

It is yet another object of this invention to provide a peripheral seal with minimum drag on a rotary exchanger wheel.

It is still a further object of this invention to provide an efficient yet simple seal design for a radial peripheral seal juncture.

These and other objects, advantages and features of this invention will become apparent from the description together with the drawings.

BRIEF DESCRIPTION OF THE DRAWINGS

The above mentioned and other features of this invention and the manner of obtaining them will become more apparent and the invention best understood by reference to the following description of different embodiments of the invention taken in conjunction with the drawings wherein.

PREFERRED EMBODIMENTS OF THE INVENTION

Figure 1:
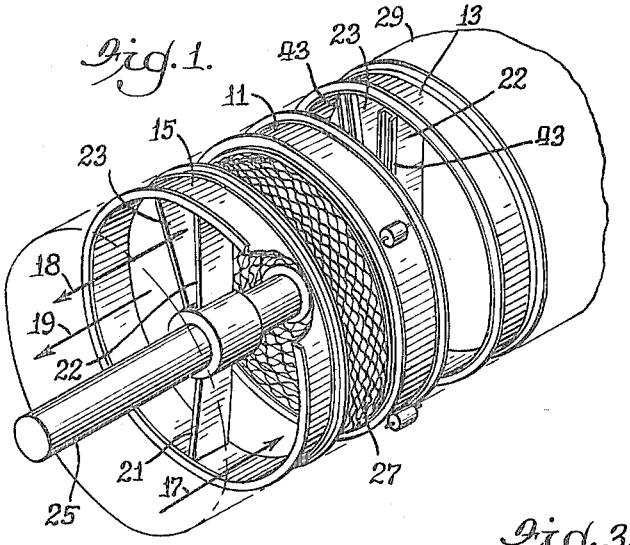
FIG. 1 shows in perspective, an exploded view of a typical rotary regenerative exchanger wheel with adjacent support and ducting members.

FIG. 1 illustrates an exemplary rotary regenerative exchanger assembly wherein exchanger wheel 11 is juxtaposed between support members 13 and 15 within duct 29. Exchanger wheel 11 can be divided into a plurality of ducted treatment sections such as treatment stream section 17 through which the gas to be treated passes and regeneration sections 18 and 19 through which regeneration gases pass. Baffles 21, 22 and 23 divide the gas streams as desired through duct 29 and regenerative exchanger wheel 11. It is apparent that baffles can be arranged to provide passage of a gas stream through any size arcuate area of the exchanger wheel and to provide for any number of different gas streams as desired for a particular process. Exchanger wheel 11 is supported by shaft 25 for desired rotation. Exchanger wheel 11 can be rotated by peripheral gearing as will be more fully described with reference to FIG. 2. Exchanger wheel 11 is comprised of exchange material 27 having axial gas flow passages and fabricated from or treated with active material to accomplish desired specific purposes such as $CO_2$ or moisture removal and the like. For convenience, reference may be made throughout this disclosure to an adsorption air conditioner system, but it should be understood that this reference is merely illustrative and the same principles apply to other rotary regenerative exchangers used for chemical or vapor removal or heat exchange.

Figure 2:
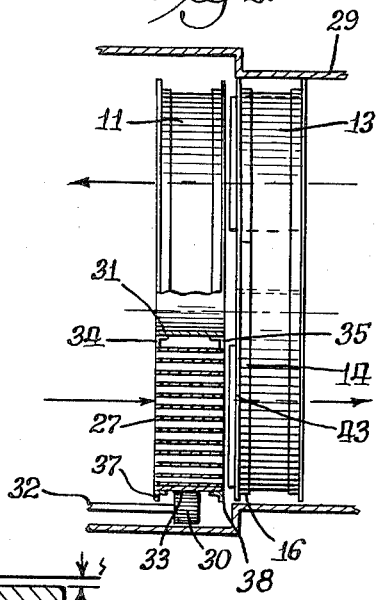
FIG. 2 is a partly sectional side view of a typical rotary regenerative exchanger wheel and adjacent support member detailing seal contact surfaces.

FIG. 2 illustrates in more detail the juxtaposed assembly of exchanger wheel 11 and support member 13. Exchanger wheel 11 comprises axial flow exchange material 27 disposed between central hub 31 and outer rim 33. Central hub 31 has peripheral flange 34 on one face and peripheral flange 35 on the other face which operate as contact surfaces for radial and for inner peripheral seals as described in more detail below. Similarly, outer rim 33 has peripheral flange 37 and peripheral flange 38 which serve as contact surfaces for radial and for outer peripheral seals. Support member 13 is similarly constructed with respect to the central hub and outer rim. Support member 13 has inner and outer peripheral surfaces, 14 and 16, respectively, juxtaposed to peripheral flanges 35 and 38 on exchanger wheel 11. Fastened to the face of support member 13 adjacent exchanger wheel 11 on the face of each baffle 21, 22 and 23 is a U-shaped channel bar 43 which radially spans the distance between central hub and outer rim 33 of support member 13. U-shaped channel bars 43 act as a radial seal stationary channel as described in more detail below. As shown in FIG. 2, exchanger wheel 11 may be rotated by peripheral drive gear or friction drive 30 powered by drive shaft 32.

Figure 3:
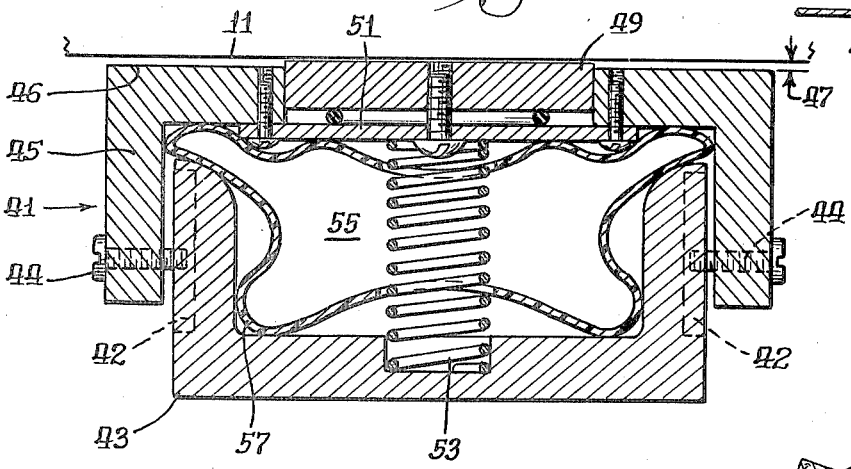
FIG. 3 is an end sectional view of a radial seal assembly according to one embodiment of this invention.

FIG. 3 illustrates an embodiment of the radial seal assembly of this invention. Radial seal assembly 41 comprises stationary channel bar 43 and floating channel bar 45 which are engaged to form a tubular channel which may vary in depth. Smaller stationary channel bars 43 are fastened by conventional means to the face of gas baffles in support member 13 and act to support radial seal assemblies 41. Larger floating channel bar 45 faces exchanger wheel 11 and acts as a floating radial seal. A significant advantage of the radial seal assembly of this invention is that it is constructed of commercially available extruded channels which are easily machined. Radial seal channels can be made of any metal or plastic compatible with process conditions such as temperature, pressure and corrosion. A controlled clearance 47 is maintained between the radial seal and the face of exchange material 27 of exchanger wheel 11 by spacers 49 retained at each end of rigid floating channel bar 45 by spacer plate 51. Spacers 49 lightly contact the inner and outer peripheral flanges of exchanger wheel 11. Clearance 47 can be adjusted to meet design specifications by exchanging spacer 49 or by shimming spacer plate 51 from the bottom of floating channel bar 45. For example, when used in an adsorption air conditioning unit a controlled clearance less than 0.010 inch is preferred. Spacers 49 are made of a material which have a low coefficient of friction with the material from which the peripheral flanges of exchanger wheel 11 are fabricated. For example, a polytetrafluorethylene such as "Teflon", chlorotrifluoethylene such as "Kel-F" are suitable material for spacers 49. A lubricant material such as graphite or molybdenum disulfide may be used. A constant force is applied by coil springs 53 positioned near each end of channel space 55, so that spacers 49 remain in contact with inner and outer peripheral flanges of exchanger wheel 11, creating controlled clearance 47 between the face of exchange material 27 of exchanger wheel 11 and face 46 of floating channel bar 45. In addition, the spring pressure will tend to reduce exchanger wheel wobble during rotation. Floating channel bar 45 is maintained in loose assembly relation with stationary channel bar 43 by two screws 44 at the center of and extending through the sides of floating channel bar 45 and projecting in loose fit relationship into slots 42 in the sides of stationary channel bar 43 at a location corresponding to the center of floating bar 45.

Flexible tube 57 is positioned for substantially the full length of channel space 55 of each radial seal assembly 41 to reduce leaks across channel space 55 due to loose tolerances between stationary channel bar 43 and floating channel bar 45. Any material having lasting resilience and flexibility throughout the operating temperature range is suitable for flexible tube 57. Suitable materials include rubber materials, such as rubber, and synthetic polymeric materials such as vinyl, polyethylene, polypropylene, urethane and the like. Flexible tube 57 may be open at each end and dependent upon wall resilience for sealing or may be relatively thin-walled and closed at each end with enclosed air or gas aiding in resilience desired for sealing.

Figure 4:
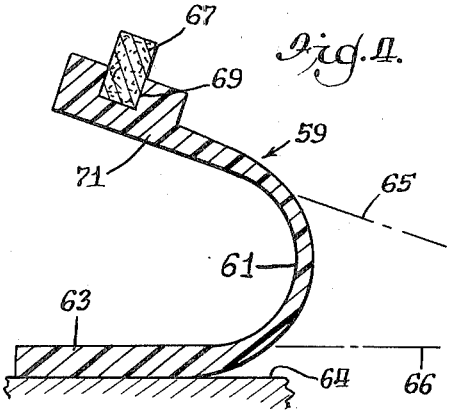
FIG. 4 is a sectional view of a peripheral seal assembly according to one embodiment of this invention.

FIG. 4 illustrates a cross section view of one embodiment of a suitable peripheral seal 59 for use in this invention. The peripheral seal body is of generally U-shaped cross section and may be made of a resilient material such as extruded silicone rubber. It should be understood that the peripheral seal body can be formed from other resilient materials such as thin-gauge metal without departing from the basic principles of this invention.

Seal leg 63, one leg of the U-shape is secured to peripheral contact surface 64 of support member 13 by conventional adhesive means. Seal leg 63 is joined to opposing seal leg 71 by central section 61. As shown in FIG. 4, a strip of low friction contact material 67, such as felt, is inserted into mounting groove 69 of seal leg 71. Felt materials 67 is secured in mounting groove 69 by conventional adhesive means. Low friction contact material 67 may be of any suitable width and instead of a separate strip, the outer surface of seal leg 71 may be of desired shape to directly engage the peripheral contact surface of the exchanger wheel. In such cases, a low friction coarting or lubricant may be used to reduce friction.

Seal legs 63 and 71 are angled apart from being parallel to one another when unloaded, so that when in assembled position, the contact surface of leg 71 lightly contacts peripheral contact surface 38 of exchanger wheel 11 with force supplied by the resiliency properties of the U-shaped peripheral seal body 61. The unloaded angle measured by the extended angle of intersection of leg 71 with leg 63, as shown by extended lines 65 and 66 will depend on the peripheral seal body material used and sealing force desired. For example, in adsorption air conditioning units employing peripheral seals of silicone rubber, an unloaded angle of about 10° to about 30° is suitable, about 15° to about 25° being preferred. The sealing force may also be varied by making control section 61 thicker or thinner. Flexibility of peripheral seal body 59 along its entire length aids in maintaining a good seal across variable distances between the exchange wheel and the adjacent support member caused by axial misalignment and uneveness of the contact surfaces. It should be understood that similar peripheral seals are used to seal the inner hub of the exchanger wheel and that similar peripheral seal assemblies are positioned on both faces of said exchanger wheel.

Figure 5:
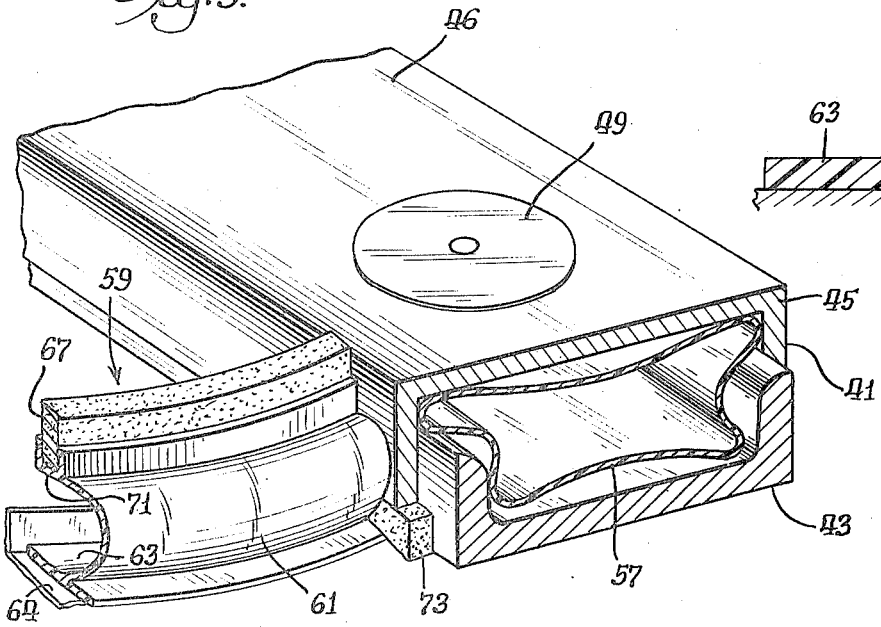
FIG. 5 is a perspective view of the juncture between radial and peripheral seals according to one embodiment of this invention.

FIG. 5 shows the juncture point between radial and peripheral seals of one embodiment of this invention. Radial seal assembly 41 spans the exchanger wheel radially such that spacer elements 49 located at each end of the radial seal assembly touch the contact surfaces of the hub and rim of the exchanger wheel. Peripheral seal assembly 59 is secured on peripheral flange surface 64 of support member 13 such that low friction contact material 67 contacts juxtapositioned peripheral surfaces of the exchanger wheel and in line with spacer elements 49. Peripheral seal assembly 59 is trimmed to allow radial seal assembly 41 to extend radially beyond peripheral seal 59. A compression fit between peripheral and radial seal assemblies seals juncture point between the two seal assemblies. In addition, a resiliant plug 73 may be inserted into the open area below floating channel bar 45.

The seal system of this invention provides reduced air leakage between adjacent ducts and around the periphery of a rotary exchanger. The reduced friction forces encountered with the seals of this invention reduce driving power requirements and thereby reduce overall energy requirements of, for example, open-cycle air conditioning apparatus driven at least in part by solar energy sources. Central shaft supported rotary exchangers have been found to exhibit low wheel wobble and are thus most satisfactory for use in this invention. A specific peripheral seal suitable for use in accordance with this invention for heat exchange wheels and drying wheels in open-cycle air condition apparatus similar to that described in U.S. Pat. No. 4,180,126 is in the shape shown in FIG. 4 having legs 0.750 inch long and 0.125 inch thick; a web 0.0625 inch thick and radius of 0.375 inch; a 20° unloaded extended angle of intersection of the legs; and made of extruded soft silicone rubber.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A floating seal system for rotary exchanger mechanisms operated between support members within a divided duct to reduce gas leakage around the periphery of the rotary device and across the face of the rotary device, said seal system comprising peripheral and radial seals comprising:

an outer peripheral seal secured to an outer peripheral surface of said support member juxtapositioned to an outer peripheral flange of said rotary device, said peripheral seal body made of resilient material having a generally U-shape cross section of two legs joined at one end by a central section, one of said legs secured to said support member outer peripheral surface and the other of said legs having on its outer surface low friction material for contact with said rotary device outer peripheral flange, said legs forming an extended angle of intersection of about 10° to about 30° in the unloaded condition to provide even sealing forces against said rotary device outer peripheral flange in loaded condition, said peripheral seal extending completely around the periphery of said support member except where intersected by said radial seals;

a radial seal assembly secured to said support member along the divider of said duct, said radial seal assembly comprising a smaller channel bar secured to said divider of said support member, a larger inverted, rigid, floating channel bar having its legs freely movable over the legs of said smaller channel bar and forming a tubular channel therewith, a resilient flexible tube positioned within said tubular channel for substantially its full length to reduce gas leakage across said tubular channel, a spacer near each end of said floating channel extending beyond the face of said floating channel a distance to provide desired clearance between said floating channel and the face of said rotary device, said spacer at each end of said floating channel maintained in contact relation with contact surfaces of said rotary device by spring means near each end of said floating channel coacting between said smaller channel and said floating channel thereby maintaining a controlled clearance between the face of said rotary device and the face of said floating channel bar; and said peripheral seal ends abutting the legs of said floating channel of each said radial seal assembly.

2. The floating seal system of claim 1 additionally comprising an inner peripheral seal secured to an inner peripheral surface of said support member juxtapositioned to an inner peripheral flange of said rotary device, said peripheral seal body made of resilient material having a generally U-shaped cross section of two legs joined at one end by a central section, one of said legs secured to said support member inner peripheral surface and the other of said legs having on its outer surface low friction material for contact with said rotary device inner peripheral flange, said legs forming an extended angle of intersection of about 10° to about 30° in the unloaded condition to provide even sealing forces against said rotary device inner peripheral flange in loaded condition, said peripheral seal extending completely around the inner hub of said support member except where intersected by said radial seals.

3. The floating seal system of claim 1 wherein said outer peripheral seal other leg additionally comprises on its outer surface a mounting groove for replaceably mounting said low friction material for contact with said rotary device outer peripheral flange.

4. The floating seal system of claim 1 wherein said outer peripheral seal other leg outer surface is shaped to directly contact said rotary device outer peripheral flange.

5. The floating seal system of claim 1 wherein said extended angle of intersection of the outer peripheral seal legs is about 15° to about 25°.

6. The floating seal system of claim 2 wherein said inner peripheral seal other leg additionally comprises on its outer surface a mounting groove for replaceably mounting said low friction material for contact with said rotary device inner peripheral flange.

7. The floating seal system of claim 2 wherein said inner peripheral seal other leg outer surface is shaped to directly contact said rotary device inner peripheral flange.

8. The floating seal system of claim 2 wherein said extended angle of intersection of the inner peripheral seal legs is about 15° to about 25°.

9. The floating seal system of claim 2 wherein said outer and inner peripheral seals are made of silicone rubber.

10. The floating seal system of claim 1 wherein said resilient flexible tube of said radial seal assembly has open ends and is made of a resilient, flexible material selected from the group consisting of rubber, vinyl, polyethylene, polypropylene and polyurethane.

11. The floating seal system of claim 2 wherein said resilient flexible tube of said radial seal assembly has open ends and is made of a resilient, flexible material selected from the group consisting of rubber, vinyl, polyethylene, polypropylene and polyurethane.

12. The floating seal system of claim 1 wherein said resilient flexible tube of said radial seal assembly has closed ends retaining gas within said tube to aid in sealing, said tube being made of a resilient, flexible material selected from the group consisting of rubber, vinyl, polyethylene, polypropylene and polyurethane.

13. The floating seal system of claim 2 wherein said resilient flexible tube of said radial seal assembly has closed ends retaining gas within said tube to aid in sealing, said tube being made of a resilient, flexible material selected from the group consisting of rubber, vinyl, polyethylene, polypropylene and polyurethane.

14. The floating seal system of claim 1 wherein said spacers extend through a hole in said floating channel bar between said legs and are mounted on a spacer plate secured to the inside of said floating channel bar, different desired clearance obtained by exchanging said spacers.

15. The floating seal system of claim 2 wherein said spacers extend through a hole in said floating channel bar between said legs and are mounted on a spacer plate secured to the inside of said floating channel bar, different desired clearance obtained by exchanging said spacers.

16. The floating seal assembly of claim 1 wherein said clearance between said floating channel and said face of said rotary device is maintained at less than about 0.01 inch.

17. The floating seal assembly of claim 2 wherein said clearance between said floating channel and said face of said rotary device is maintained at less than about 0.01 inch.

18. The floating seal system of claim 1 wherein said spring means comprises a coil spring.

19. The floating seal system of claim 2 wherein said spring means comprises a coil spring.

20. The floating seal system of claim 1 wherein said smaller channel bar and said larger floating channel bar are maintained in loose assembly relation by screws extending through the sides of said floating channel bar projecting in loose fit relationship into slots in the sides of said smaller channel bar.

21. The floating seal system of claim 2 wherein said smaller channel bar and said larger floating channel bar are maintained in loose assembly relation by screws extending through the sides of said floating channel bar projecting in loose fit relationship into slots in the sides of said smaller channel bar.

22. In an open-cycle air conditioning apparatus of the type comprising; a treatment passageway and a separate regenerative passageway, a sensible heat exchanger means for transfer of thermal energy from one of said passageways to the other, and a desiccant means for transfer of moisture from the treatment passageway to the regenerative passageway, the improvement comprising:

said sensible heat exchanger means being a thermal exchange rotary device supported by a central shaft within a divided duct and operated between support members;

said desiccant means being a regenerable desiccant rotary device supported by a central shaft within a divided duct and operated between support members;

said thermal exchange rotary device and said desiccant rotary device having on each side thereof:

an outer peripheral seal secured to an outer peripheral surface of said support member juxtapositioned to an outer peripheral flange of said rotary device, said peripheral seal body made of resilient material having a generally U-shaped cross section of two legs joined at one end by a central section, one of said legs secured to said support member outer peripheral surface and the other of said legs having on its outer surface low friction material for contact with said rotary device outer peripheral flange, said legs forming an extended angle of intersection of about 10° to about 30° in the unloaded condition to provide even sealing forces against said rotary device outer peripheral flange in loaded condition, said peripheral seal extending completely around the periphery of said support member except where intersected by said radial seals;

an inner peripheral seal secured to an inner peripheral surface of said support member juxtapositioned to an inner peripheral flange of said rotary device, said peripheral seal body made of resilient material having a generally U-shaped cross section of two legs joined at one end by a central section, one of said legs secured to said support member inner peripheral surface and the other of said legs having on its outer surface low friction material for contact with said rotary device inner peripheral flange, said legs forming an extended angle of intersection of about 10° to about 30° in the unloaded condition to provide even sealing forces against said rotary device inner peripheral flange in loaded condition, said peripheral seal extending completely around the inner hub of said support member except where intersected by said radial seals;

a radial seal assembly secured to said support member along the divider of said duct, said radial seal assembly comprising a smaller channel bar secured to said divider of said support member, a larger inverted, rigid, floating channel bar having its legs freely movable over the legs of said smaller channel bar and forming a tubular channel therewith, a resilient flexible tube positioned within said tubular channel for substantially its full length to reduce gas leakage across said tubular channel, a spacer near each end of said floating channel extending beyond the face of said floating channel a distance to provide desired clearance between said floating channel and the face of said rotary device, said spacer at each end of said floating channel maintained in contact relation with contact surfaces of said rotary device by spring means near each end of said floating channel coacting between said smaller channel and said floating channel thereby maintaining a controlled clearance between the face of said rotary device and the face of said floating channel bar; and said peripheral seal ends abutting the legs of said floating channel of each said radial seal assembly.

23. The floating seal system of claim 22 wherein said outer and inner peripheral seal other legs additionally comprise on their outer surfaces a mounting groove for replaceably mounting said low friction material for contact with said rotary device outer and inner peripheral flanges.

24. The floating seal system of claim 22 wherein said outer and inner peripheral seal other leg outer surfaces are shaped to directly contact said rotary device outer and inner peripheral flanges.

25. The floating seal system of claim 22 wherein said extended angle of intersection of the outer and inner peripheral seal legs is about 15° to about 25°.

26. The floating seal system of claim 22 wherein said outer and inner peripheral seals are made of silicone rubber.

27. The floating seal system of claim 22 wherein said resilient flexible tube of said radial seal assembly has open ends and is made of a resilient, flexible material selected from the group consisting of rubber, vinyl, polyethylene, polypropylene and polyurethane.

28. The floating seal system of claim 22 wherein said resilient flexible tube of said radial seal assembly has closed ends retaining gas within said tube to aid in sealing, said tube being made of a resilient, flexible material selected from the group consisting of rubber, vinyl, polyethylene, polypropylene and polyurethane.

29. The floating seal system of claim 22 wherein said spacers extend through a hole in said floating channel bar between said legs and are mounted on a spacer plate secured to the inside of said floating channel bar, different desired clearance obtained by exchanging said spacers.

30. The floating seal assembly of claim 22 wherein said clearance between said floating channel and said face of said rotary device is maintained at less than about 0.01 inch.

31. The floating seal system of claim 22 wherein said spring means comprises a coil spring.

32. The floating seal system of claim 22 wherein said smaller channel bar and said larger floating channel bar are maintained in loose assembly relation by screws extending through the sides of said floating channel bar projecting in loose fit relationship into slots in the sides of said smaller channel bar.

* * * * *